US010584916B2

(12) United States Patent
Gan et al.

(10) Patent No.: US 10,584,916 B2
(45) Date of Patent: Mar. 10, 2020

(54) WATER-FEED ASSEMBLY OF ICE MAKER IN REFRIGERATOR AND REFRIGERATOR

(71) Applicant: Hisense Ronshen (Guangdong) Refrigerator Co., Ltd., Foshan, Guangdong (CN)

(72) Inventors: Jinbo Gan, Guangdong (CN); Kangfu Yan, Guangdong (CN); Donghua Fu, Guangdong (CN)

(73) Assignee: Hisense Ronshen (Guangdong) Refrigerator Co., Ltd., Foshan, Guangdong (CN)

( * ) Notice: Subject to any disclaimer, the term of this patent is extended or adjusted under 35 U.S.C. 154(b) by 139 days.

(21) Appl. No.: 16/023,272

(22) Filed: Jun. 29, 2018

(65) Prior Publication Data

US 2019/0128595 A1 May 2, 2019

(30) Foreign Application Priority Data

Oct. 31, 2017 (CN) ..... 2017 1 1050920

(51) Int. Cl.
*F25D 23/12* (2006.01)
*F25C 5/20* (2018.01)
*F25D 21/04* (2006.01)

(52) U.S. Cl.
CPC ..... *F25D 23/126* (2013.01); *F25C 5/22* (2018.01); *F25D 21/04* (2013.01);
(Continued)

(58) Field of Classification Search
CPC .... F25D 23/126; F25D 21/04; F25D 2400/40; F25D 2323/122; F25D 2323/121;
(Continued)

(56) References Cited

U.S. PATENT DOCUMENTS 3,866,434 A 2/1975 Pugh et al.
2010/0083685 A1* 4/2010 Kim ..... F25C 5/22 62/347
2018/0017308 A1* 1/2018 Yang ..... F25C 1/24

FOREIGN PATENT DOCUMENTS

CN 1469094 A 1/2004
CN 1254651 C 5/2006
(Continued)

OTHER PUBLICATIONS

First Office Action received from the State Intellectual Property Office of People's Republic of China for Application No. 201711050920.4 dated Jan. 16, 2019 (Chinese language only) (5 pp.).

(Continued)

*Primary Examiner* — Emmanuel E Duke
(74) *Attorney, Agent, or Firm* — Brinks Gilson & Lione

(57) ABSTRACT

A water-feed assembly of an ice maker in the refrigerator includes a diversion pipe, and an outer wall of the diversion pipe is covered with a heating layer. The first end of the diversion pipe is used to communicate with a water-outlet pipe in the ice maker of the refrigerator, and a second end of the diversion pipe is connected to a locating sleeve. The inner wall of the port of the locating sleeve away from the diversion pipe includes a resilient sealing sleeve. A radial flange is formed at an outer end of the resilient sealing sleeve. The end of the locating sleeve away from the diversion pipe is connected to a water pipe seat, and both sides of the radial flange abut against the water pipe seat and an end face of the locating sleeve, respectively.

20 Claims, 6 Drawing Sheets

(52) U.S. Cl.
CPC ..... *F25C 2400/14* (2013.01); *F25C 2500/08* (2013.01); *F25D 2323/121* (2013.01); *F25D 2323/122* (2013.01); *F25D 2400/40* (2013.01)

(58) Field of Classification Search
CPC ..... F25D 23/12; F25C 5/22; F25C 2500/08; F25C 2400/14; F25C 1/00
See application file for complete search history.

(56) References Cited

FOREIGN PATENT DOCUMENTS

| | | | |
|---|---|---|---|
| CN | 201340154 | Y | 11/2009 |
| CN | 202166248 | U | 3/2012 |
| CN | 205825528 | U | 12/2016 |
| CN | 106871552 | A | 6/2017 |
| CN | 107830668 | A | 3/2018 |
| EP | 1 382 923 | A1 | 1/2004 |
| JP | 2011-52933 | | 3/2011 |
| WO | WO 2012/136557 | A2 | 10/2012 |
| WO | WO 2013/007687 | A2 | 1/2013 |

OTHER PUBLICATIONS

Chinese Search Report for corresponding Application No. PCT/CN2018/093805.

* cited by examiner

WATER-FEED ASSEMBLY OF ICE MAKER IN REFRIGERATOR AND REFRIGERATOR

CROSS-REFERENCE TO RELATED APPLICATION

This application claims benefit and priority to Chinese Patent Application No. 201711050920.4, filed on Oct. 31, 2017, titled "WATER-FEED ASSEMBLY OF ICE MAKER IN REFRIGERATOR AND REFRIGERATOR", which is incorporated herein by reference in its entirety.

TECHNICAL FIELD

The present disclosure relates to a field of refrigerator technologies, and more particularly to a water-feed assembly of an ice maker in a refrigerator and the refrigerator.

BACKGROUND

With improvements of the quality of life, a refrigerator product with an ice making function is more and more popular. An ice-making function module of a refrigerator usually is set in a specific area with a temperature below zero degrees Celsius in a freezer compartment or a cooler compartment of the refrigerator. The water used for making ice is introduced into an ice-making system from an outside water source through a specific waterway system (i.e., through a water-feed pipeline supplying water for ice-making water). However, since the temperature of the area where the ice-making function module is located is lower than 0 degrees Celsius, it is necessary to ensure that a water-feed pipeline supplying water for ice-making will not freeze, so as not to affect making ice.

SUMMARY

Some embodiments of the present disclosure provide a water-feed assembly of an ice maker in a refrigerator, comprising: a diversion pipe, an outer wall of which is covered with a heating layer, and a first end of which is used for communicating with a water-outlet pipe in the ice maker of the refrigerator; a locating sleeve, connected with a second end of the diversion pipe; a resilient sealing sleeve, comprising a body portion provided on an inner wall of a port of the locating sleeve away from the diversion pipe, and a radial flange extending from an outer end of the body portion along an end face of the locating sleeve; and a water pipe seat, one end of which is connected to one end of the locating sleeve away from the diversion pipe, the water pipe seat being abutted against one side of the radial flange, and the other side of the radial flange being abutted against the end face of the locating sleeve.

On the other hand, some embodiments of the present disclosure further provide a refrigerator, comprising a box provided with a freezer compartment, an ice maker being provided in the freezer compartment, wherein, a pre-embedded pipe is provided in a foamed layer of an inner liner of the freezer compartment, a first end of the pre-embedded pipe communicates with an outside of the box, and a second end of the pre-embedded pipe communicates with the freezer compartment and is opposite to an ice making area in the ice maker, and the above water-feed assembly is detachably provided in the pre-embedded pipe, a resilient sealing sleeve of the water-feed assembly is provided near the first end of the pre-embedded pipe, and a water-inlet pipe is provided in the pre-embedded pipe.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art can obtain other drawings according to those drawings without paying any creative effort.

DETAILED DESCRIPTION

Figure 1:
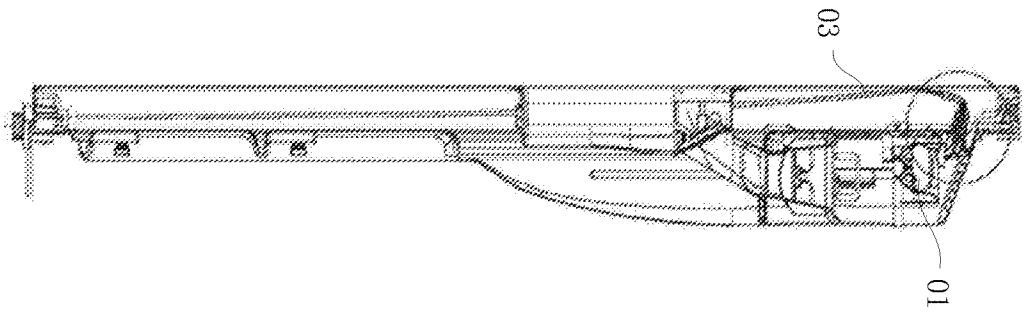
FIG. 1 is a structure diagram of a water-feed assembly of an ice maker in a refrigerator according to a related art.

The technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

In the description of the present disclosure, it should be understood that the orientations or positional relationships indicated by terms such as "center", "upper", "lower", "front", "back", "left", "right", "vertical", "horizontal", "top," "bottom", "inner" and "outer" are based on the orientation or positional relationship shown in the drawings and fittings, provided merely for ease of description of the present disclosure and simplified description. They are not intended to indicate or imply that the devices or elements referred to must have specific orientations, and are constructed and operated in the specific orientations. Therefore they should not be construed to limit the present disclosure.

Terms "first" and "second" are used for descriptive purposes only and are not to be construed as indicating or implying relative importance or implicitly indicating the number of indicated technical features. Thus, features defined by "first" or "second" may explicitly or implicitly include one or more of the features. In the description of the present disclosure, unless otherwise specified, "a plurality of" means two or more than two.

In the description of the present disclosure, it should be noted that terms "install", "connected", and "connect" should be understood in a broad sense unless specifically defined or defined otherwise, and may be, for example, a fixed connection or a detachable connection, or connecting integrally; Those of ordinary skill in the art can understand the specific meanings of the above terms in the present disclosure according to specific circumstances.

Figure 2:
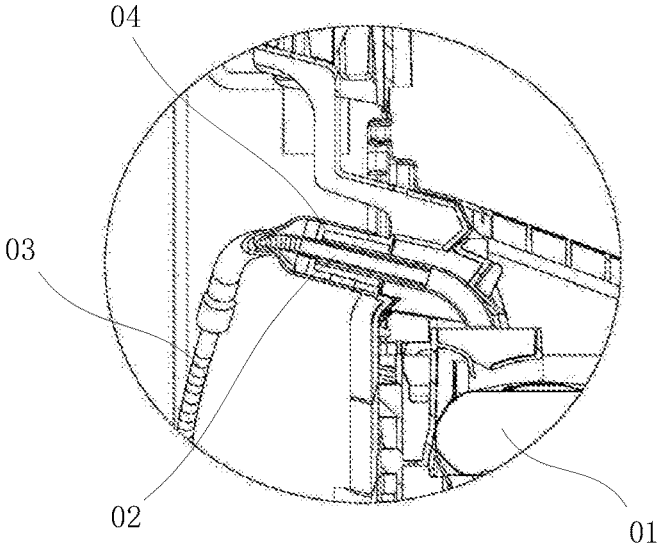
FIG. 2 is a partial enlarged structure diagram of a water-feed assembly of an ice maker in a refrigerator according to the related art.

A water-feed assembly of an ice maker in a refrigerator in a related art, as shown in FIGS. 1 and 2, includes a heating pipe 02 installed above an ice maker 01. One end of the heating pipe 02 leads to the ice maker 01, and the other end is connected to a water-inlet pipe 03. Water of an external water source is introduced into the ice maker 01 via the water-inlet pipe 03 and the heating pipe 02. The heating pipe 02 includes a metal pipe, a heating wire wrapped around the metal pipe, and an insulation protection cover. By heating of the heating wire, ice formation in the water-inlet pipe may be avoided. In order to make a connection position between the water-inlet pipe 03 and the heating pipe 02 more secure, an installation cylinder 04 is provided at the connection position of the water-inlet pipe 03 and the heating pipe 02. A plurality of clips are vertically provided on an inner side of the installation cylinder 04, and the clips are arranged along a radial direction of the installation cylinder 04. The heating pipe 02 is inserted into the installation cylinder 04 and has interference fits with the clips. The water-inlet pipe 03 is inserted into the heating pipe 02 to achieve a connection between the water-inlet pipe 03 and the heating pipe 02.

In the above water-feed assembly of the ice maker in the refrigerator, the connection between the water-inlet pipe 03 and the heating pipe 02 may be achieved by the interference fit between the clips in the installation cylinder 04 and the heating pipe 02, the water-inlet pipe 03. The clips squeeze the heating pipe 02 and the water-inlet pipe 03 to increase a friction force, and therefore the water-inlet pipe 03 and the heating pipe 02 are fixedly connected. However, there is bound to be a certain gap between these clips, so that a sealing effect here may be not good and a phenomenon of water leakage or cool leakage may occur, which will affect a cooling effect.

The related art is information related to this disclosure, but the related art not necessarily prior art.

Figure 3:
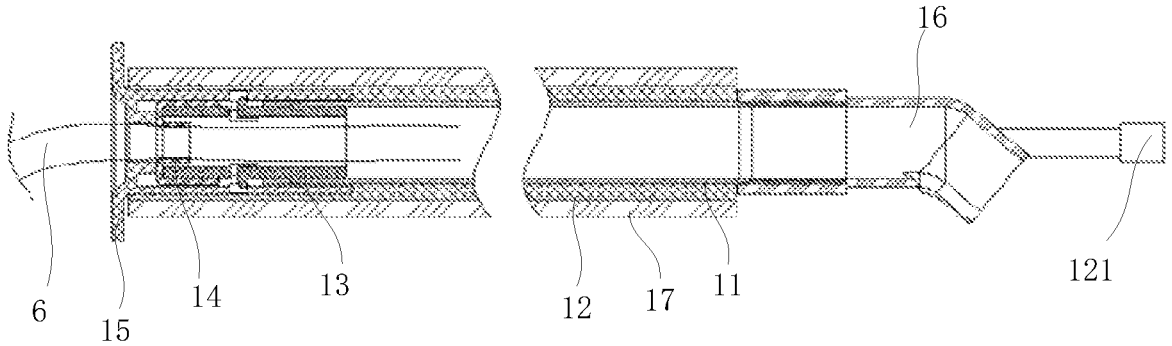
FIG. 3 is a structure diagram of a water-feed assembly of an ice maker in a refrigerator according to some embodiments of the present disclosure.
Figure 4:
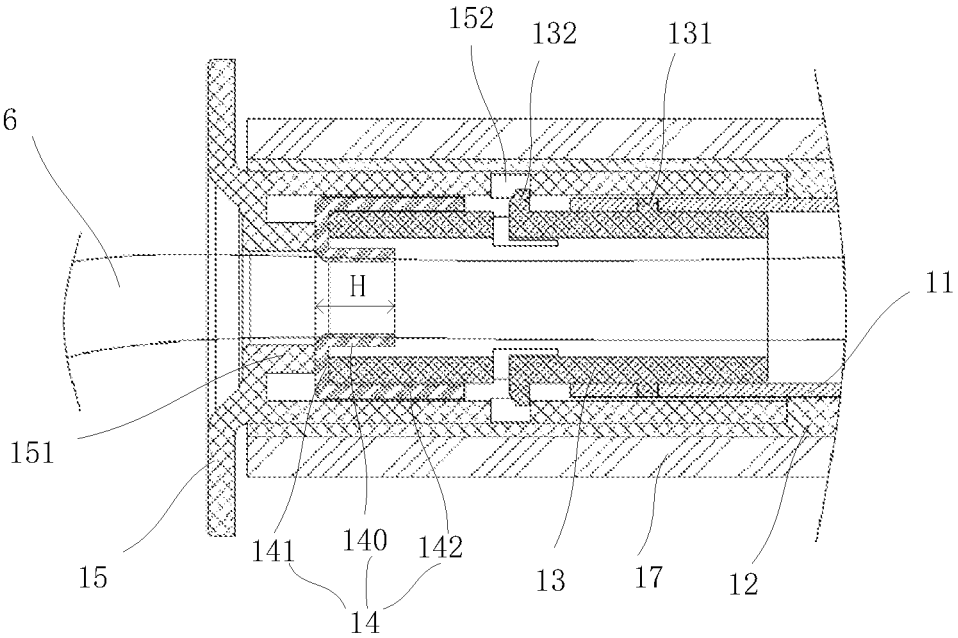
FIG. 4 is a partially enlarged structure diagram of a water-feed assembly of an ice maker in a refrigerator according to some embodiments of the present disclosure.

Some embodiments of the present disclosure provide a water-feed assembly 1 of an ice maker in a refrigerator. As shown in FIGS. 3 and 4, the water-feed assembly includes a diversion pipe 11, a locating sleeve 13, a water pipe seat 15, and a resilient sealing sleeve 14. An outer wall of the diversion pipe 11 is covered with a heating layer 12. A first end of the diversion pipe 11 is used to communicate with a water-outlet pipe 16 in the ice maker in the refrigerator, and a second end of the diversion pipe 11 is connected to the locating sleeve 13. An inner wall of a port of the locating sleeve 13 away from the diversion pipe 11 is provided with the resilient sealing sleeve 14. The resilient sealing sleeve 14 includes a body portion 140 provided on the inner wall of the port of the locating sleeve 13 away from the diversion pipe 11, and a radial flange 141 extended from an outer end of the body portion 140 along an end face of the locating sleeve 13. One end of the locating sleeve 13 away from the diversion pipe 11 is connected with the water pipe seat 15. One side of the radial flange 141 of the resilient sealing sleeve 14 abuts against the end face of the locating sleeve 13, and the other side of the radial flange 141 abuts against the water pipe seat 15.

As shown in FIGS. 3 and 4, the water-feed assembly 1 of the ice maker in the refrigerator according to the embodiment of the present disclosure may prevent ice formation within the diversion pipe 11 by a heating of the heating layer 12 covered on the outer wall of the diversion pipe 11. A water-inlet pipe 6 communicating with an external water source may be connected to the diversion pipe 11 through the resilient sealing sleeve 14. Due to resilient sealing property of the resilient sealing sleeve 14, connection positions in the pipeline of the water-feed assembly may be sealed. In addition, in order to prevent an axial displacement of the resilient sealing sleeve 14 when the pipeline is connected, the outer end of the resilient sealing sleeve 14 is formed with the radial flange 141, and two sides of the radial flange 141 are abuts against to the end face of the locating sleeve 13 and the water pipe seat 15, respectively. In this way, the movement of the resilient sealing sleeve 14 along its axial direction is limited.

The heating layer 12 may be a common heating structure. For example, the heating layer 12 includes a heating wire wound around the outer wall of the diversion pipe 11. The heating wire needs to be powered on. As shown in FIG. 3, the heating wire wound in the heating layer 12 is connected with a connection terminal 121, and the connection terminal 121 may be electrically connected with a wire in the refrigerator to be powered on. Before each ice-making cycle begins, the heating wire is controlled to be heated for a period of time to increase internal temperature of the diversion pipe 11, melting possible residual ice particles, and then water is introduced from the external water source, so as to prevent the newly injected water from freezing inside the diversion pipe 11. The diversion pipe 11 may be a plastic pipe or a metal pipe. In some embodiments, in order to improve heating efficiency, the diversion pipe 11 is the metal pipe. The metal pipe has high thermal conductivity and may improve heating efficiency.

The locating sleeve 13 is connected to the second end of the diversion pipe 11, and various connection manners may be used therein. For example, the connection between the locating sleeve 13 and the diversion pipe 11 may be a detachable structure such as a snap fit, or a non-detachable structure such as a bonding. In some embodiments, the detachable connection structure is used between the locating sleeve 13 and the diversion pipe 11 for convenience of disassembly and installation. The detachable connection structure not only facilitates an installation of the locating sleeve 13 and the diversion pipe 11, but also facilitates a replacement when one of the above components is damaged, thereby saving costs. In some embodiments, the locating sleeve 13 is nested in the second end of the diversion pipe 11, and an outer wall of the locating sleeve 13 is in interference fit with an inner wall of the second end of the diversion pipe 11, so as to realize a sealing between the locating sleeve 13 and the diversion pipe 11. In some embodiments, the second end of the diversion pipe 11 is nested in the locating sleeve 13, and an inner wall of the locating sleeve 13 is in interference fit with an outer wall of the second end of the diversion pipe 11, so as to realize a sealing of the locating sleeve 13 and the diversion pipe 11.

In some embodiments, the locating sleeve 13 is a resilient member.

Figure 6:
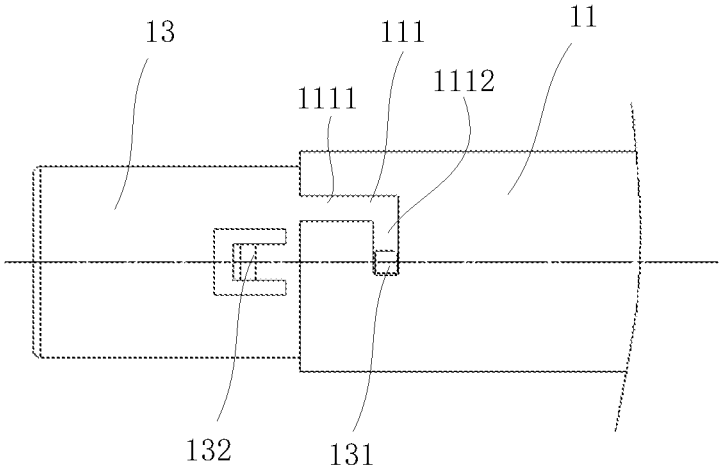
FIG. 6 is a structure diagram showing assembly of a diversion pipe and a locating sleeve in a water-feed assembly of an ice maker in a refrigerator according to some embodiments of the present disclosure.

Referring to FIGS. 4 and 6, in some embodiments of the present disclosure, one end of the locating sleeve 13 is inserted into the diversion pipe 11 and is connected by a first snap fit structure. The first snap fit structure may prevent a relative movement between the locating sleeve 13 and the diversion pipe 11 along an axial direction.

In some embodiments, as shown in FIGS. 4 and 6, the first snap fit structure includes: a limiting column 131 provided on the outer wall of the locating sleeve 13, and a groove 111 provided on an inner wall of the diversion pipe 11. The groove 111 includes an axial segment 1111 extending axially and a circumferential segment 1112 extending circumferentially. One end of the axial segment 1111 extends to the end face of the second end of the diversion pipe 11, and the other end communicates with the circumferential segment 1112. The limiting column 131 is configured to be snap-fitted with the circumferential segment 1112 to limit an axial movement of the locating sleeve 13 relative to the diversion pipe 11. In this way, when the locating sleeve 13 is connected with the diversion pipe 11, the limiting column 131 enters the groove 111 along the axial segment 1111 of the groove 111. when the limiting column 131 reaches to a connection position of the axial segment 1111 and the circumferential segment 1112 of the groove 111, the locating sleeve 13 is rotated so that the limiting column 131 enters the circumferential segment 1112 of the groove 111 and is snap-fitted with the circumferential segment 1112, so that the locating sleeve 13 may be limited to move along its axial direction, i.e., a locating sleeve 13 is connected with the diversion pipe 11.

Similarly, the locating sleeve 13 is also connected with the water pipe seat 15, and various connection manners may be used therein. For example, the connection between the locating sleeve 13 and the water pipe seat 15 may be a detachable structure such as a snap fit, or a non-detachable structure such as a bonding. In some embodiments, the detachable connection structure is used between the locating sleeve 13 and the water pipe seat 15 for convenience of disassembly and installation. The detachable connection structure not only facilitates an installation of the locating sleeve 13 and the water pipe seat 15, but also facilitates a replacement when one of the above components is damaged, thereby saving costs.

Figure 5:
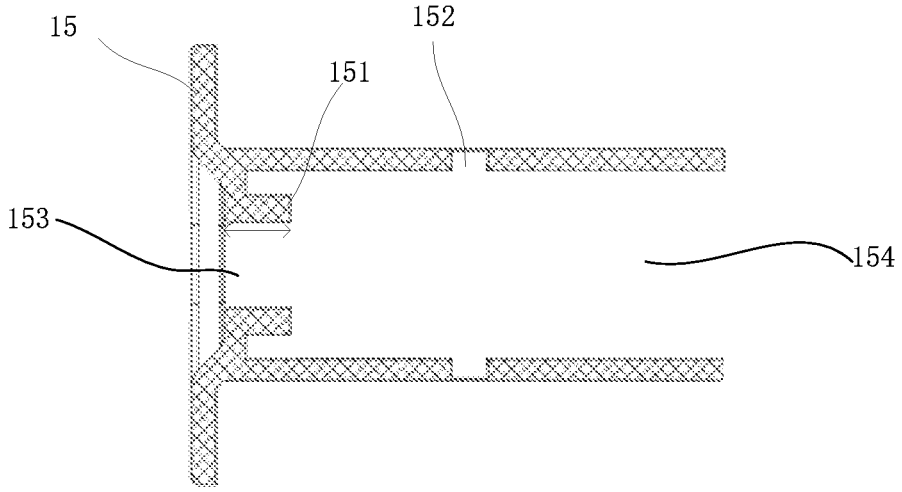
FIG. 5 is a structure diagram of a water pipe seat of a water-feed assembly of an ice maker in a refrigerator according to some embodiments of the present disclosure.

In some embodiments, as shown in FIGS. 4 and 5, the water pipe seat 15 includes a first port 153 configured to be installed into the water-inlet pipe 6, and a second port 154 configured to be connected with the locating sleeve 13. The second port 154 communicates with the first port 153. The water-inlet pipe 6 is used for communicating with the external water source. The second port 154 of the water pipe seat 15 is sleeved outside the locating sleeve 13, the inner wall of the locating sleeve 13 abuts against an outer wall of the body portion 140 of the resilient sealing sleeve 14, and an inner wall of the body portion 140 of the resilient sealing sleeve 14 abuts against an outer wall of the water-inlet pipe 6.

In some embodiments of the present disclosure, referring to FIGS. 4, 5 and 6, the second port 154 of the water pipe seat 15 (i.e., surrounded by a wall of the water pipe seat 15 extending along an axial direction of the diversion pipe 11) is sleeved on the locating sleeve 13 and a part of the diversion pipe 11. The water pipe seat 15 is connected with the locating sleeve 13 though a second snap fit structure, and the second snap fit structure may prevent relative movement between the water pipe seat 15 and the locating sleeve 13 along the axial direction.

In some embodiments, as shown in FIGS. 4 and 6, the second snap fit structure includes a resilient buckle 132 provided on the outer wall of the locating sleeve 13 and an engaging hole 152 provided on the inner wall of the second port of the water pipe seat 15. The resilient buckle 132 is snap-fitted with the engaging hole 152 to limit an axial movement of the water pipe seat 15. In this way, when the locating sleeve 13 is inserted into the water pipe seat 15, the resilient buckle 132 may be correspondingly snap-fitted into the engaging hole 152, and then the water pipe seat 15 is limited to move along an axial direction, that is, the locating sleeve 13 and the water pipe seat 15 are connected.

In some embodiments, the mating surface of the resilient buckle 132 and the engaging hole 152 is disposed to be parallel to the axial direction of the locating sleeve 13, that is, the mating surface refers to a limiting surface for preventing the buckle from coming out after the resilient buckle 132 is snap-fitted in the engaging hole 152. Since the inner wall of the water pipe seat 15 extending along the axial direction of the diversion pipe 11 and the outer wall of the diversion pipe 11 are relatively fixed through the interference fit, a circumferential rotation between the locating sleeve 13 and the diversion pipe 11 is limited by the mating surface parallel to the axial direction of the locating sleeve 13 after an engagement is completed.

As shown in FIGS. 4 and 6, only one implementation of the first snap fit structure and the second snap fit structure is exemplified. In premises that the first snap fit structure may prevent the relative movement between the locating sleeve 13 and the diversion pipe 11 along the axial direction, and the second snap fit structure may prevent the relative movement between the water pipe seat 15 and the locating sleeve 13 along the axial direction, the first snap fit structure and the second snap fit structure may be changed according to a specific internal structure of the water-feed assembly 1. For example, the implementations of the first snap fit structure and the second snap fit structure may be interchanged, or the first snap fit structure and the second snap fit structure may use the same implementation manner, or the first snap fit structure and the second snap fit structure may be implemented with other snap fit structures.

In some embodiments of the present disclosure, while the first snap fit structure and the second snap fit structure realize location fits among the water pipe seat 15, the locating sleeve 13 and the diversion pipe 11, the location fits among the water pipe seat 15, the locating sleeve 13 and the diversion pipe 11 are inference fits, in order to make structure more compact, and prevent a leakage of cold air inside the refrigerator or a leakage of water in the water-feed assembly. Furthermore, fit gaps between the first snap fit structure and the second snap fit structure are sealed with a sealant to further ensure no leakage of the seal, so as to block a leakage of cold air inside a freezer box and prevent a leakage of water.

In some embodiments of the present disclosure, as shown in FIGS. 4 and 5, the second port 154 (the port near the locating sleeve 13) of the water pipe seat 15 is provided with a stop projection 151. The stop projection 151 extends along an axial direction of the second port 154 and abuts against the radial flange 141. The water pipe seat 15 abuts against one side of the radial flange 141 through the stop projection 151, and the end face of the locating sleeve 13 abuts against the other side of the radial flange 141, so that the resilient sealing sleeve 14 may be limited to move along its axis direction.

In some embodiments of the present disclosure, for ease of assembly, as shown in FIG. 4, a distal end of the radial flange 141 is also formed with an axial flange 142 extending along an axial direction of the resilient sealing sleeve 14, and the axial flange 142 is covered on the outer wall of the locating sleeve 13. In this way, when the resilient sealing sleeve 14 is assembled with the locating sleeve 13, the radial flange 141 abuts against the end face of the locating sleeve 13 and the axial flange 142 is covered on the outer wall of the locating sleeve 13, so that the resilient sealing sleeve 14 is sleeved at one end of the locating sleeve 13, the relative position is basically fixed to facilitate subsequent installations of parts.

The resilient sealing sleeve 14 may be made of rubber with good airtightness to ensure good resilience and tightness.

In some embodiments of the present disclosure, as shown in FIGS. 3 and 4, the water-inlet pipe 6 connected to the external water source is inserted inside the water pipe seat 15, and an outlet of the water-inlet pipe 6 may not be flush with an end face of the water pipe seat 15 installed with the diversion pipe 11, i.e., the water-inlet pipe 6 may be shorter than the water pipe seat 15 in an axial direction of the diversion pipe. When the second end of the diversion pipe installed with the resilient sealing sleeve 14 and the locating sleeve 13 is inserted into the water pipe seat 15, the water-inlet pipe 6 communicates with the locating sleeve 13.

In some embodiments of the present disclosure, an outlet port of the water-inlet pipe 6 cooperates with a first port of the locating sleeve 13 to achieve a communication between the water-inlet pipe 6 and the locating sleeve 13. In this case, the resilient sealing sleeve 14 is used to seal a gap of a connection position of the water-inlet pipe 6 and the locating sleeve 13.

In some embodiments of the present disclosure, in order to make the water-inlet pipe 6 connected to the external water source closely fit with the resilient sealing sleeve 14 and the sealing effect be good, an inner diameter of a central through hole of the resilient sealing sleeve 14 is smaller than an outer diameter of the water-inlet pipe 6. In this way, a sealing effect may be good at a connection position of the water-inlet pipe 6 and the resilient sealing sleeve 14 through an interference fit therebetween. In some embodiments of the present disclosure, the axial flange 142 is also in interference fit with an outer wall of the locating sleeve 13. As shown in FIG. 4, an extending length H in the central through hole of the resilient sealing sleeve 14, the extending length H is a sealing length between the water-inlet pipe 6 and the resilient sealing sleeve 14, and the length H should maximize the value as possible without affecting assembly and manufacturability. As illustrated, H may be greater than or equal to about 5 millimeters.

In some embodiments of the present disclosure, referring to FIGS. 3 and 4, in order to prevent the water in the water pipe at the water pipe seat 15 from freezing, an outer wall of the water pipe seat 15 is covered with the heating layer 12. According to an ambient temperature and an actual need of ensuring that the diversion pipe 11 does not freeze, an entire outer wall of the water pipe seat 15 is selected to be covered with the heating layer 12, or only an outer wall of the water pipe seat 15 near the diversion pipe 11 is covered with the heating layer 12. For example, in FIG. 4, the wall of the water pipe seat 15 extending axially is covered with the heating layer 12. In some embodiments of the present disclosure, as shown in FIGS. 3 and 4, in order to prevent heat of the heating layer 12 from being lost, the heating layer 12 is also covered with a heat insulating sheath 17.

For the water-feed assembly 1 of the ice maker in the refrigerator according to some embodiments of the present disclosure, the diversion pipe 11 may be a circular pipe, or may be a pipe of other cross-sectional shape such as a square or a triangle. Correspondingly, the components fitted with the diversion pipe 11, such as the locating sleeve 13, the resilient sealing sleeve 14, the water pipe seat 15 and the water-outlet pipe 16 of the ice maker, are all in conformity with the pipe shape of the diversion pipe 11, so as to facilitate assembly. Of course, in comparison, a circular pipe is easy to manufacture and has a wide range of applications, so the above components are illustratively circular pipes.

Figure 9:
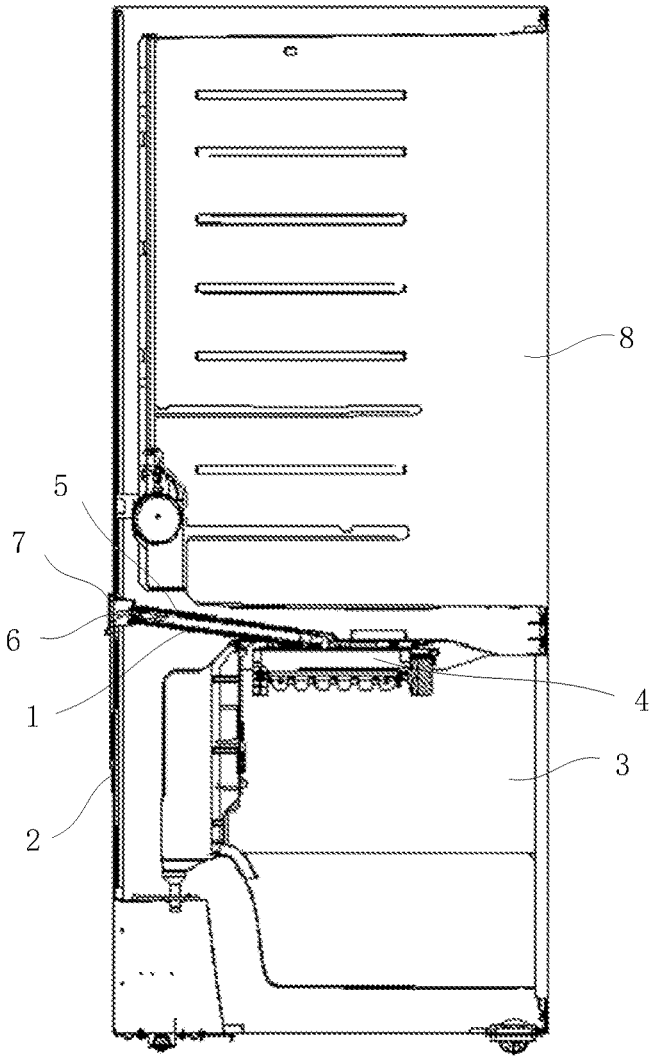
FIG. 9 is a structure diagram of a water-feed assembly provided in a refrigerator according to some embodiments of the present disclosure.
Figure 10:
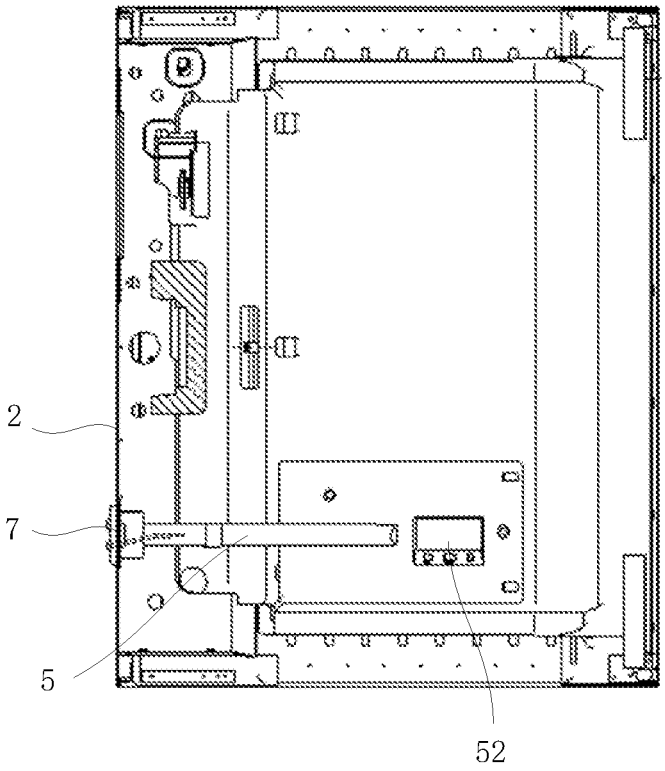
FIG. 10 is a structure diagram of a top wall of a freezer compartment of a refrigerator according to some embodiments of the present disclosure.

On the other hand, some embodiments of the present disclosure further provide a refrigerator. As shown in FIGS. 9 and 10, the refrigerator includes a box 2, and the box 2 is provided with a freezer compartment 3. The freezer compartment 3 is provided with an ice maker 4. A foamed layer of an inner liner of the freezer compartment 3 is provided with a pre-embedded pipe 5. A first end of the pre-embedded pipe 5 communicates with an outside of the box 2; a second end of the pre-embedded pipe 5 communicates with the freezer compartment 3 and is opposite to an ice making area in the ice maker 4, for example, a position where the ice container is located. The pre-embedded pipe 5 is detachably provided with the above water-feed assembly 1. The resilient sealing sleeve 14 in the water-feed assembly 1 is provided near the first end of the pre-embedded pipe 5, and the water-inlet pipe 6 is provided in the pre-embedded pipe 5.

In the above-described refrigerator, a water-feed system of the ice maker that supplies water to the ice maker includes the water-inlet pipe 6, the water-feed assembly 1 in the pre-embedded pipe 5, and the water-outlet pipe 16 in the ice maker.

For a refrigerator in some embodiments of the present disclosure, the pre-embedded pipe 5 is provided with the water-inlet pipe 6, one end of the water-inlet pipe 6 is used for communicating with an external water source, and the other end of the water-inlet pipe 6 is connected with the water-feed assembly 1 through the resilient sealing sleeve 14, so that a water supply to the ice maker 4 may be realized. The refrigerator of the embodiment of the present disclosure has similar advantageous effects as described above since the above-described water-feed assembly 1 is provided in the refrigerator, that is, it is possible to ensure that connections of the pipeline in the water-feed assembly is sealed. In addition, since the water-feed assembly 1 is detachably installed in the pre-embedded pipe 5, in the course of later use, if some components of the water-feed assembly 1 are damaged, the entire water-feed assembly 1 may be taken out from the pre-embedded pipe 5 and replaced it, which is very convenient for maintenance. Moreover, the water-feed assembly 1 is an independent component that may be produced separately and assembled in advance, and when the refrigerator is produced, the entire water-feed assembly 1 may be assembled with the pre-embedded pipe 5, which is convenient for production.

For the refrigerator according to some embodiments of the present disclosure, the first end of the pre-embedded pipe 5 communicates with the outside of the box 2, so that the water-inlet pipe 6 is installed outside the box 2, and the outlet of the water-inlet pipe 6 communicates with the water-feed assembly 1 provided in the pre-embedded pipe 5. In this way, the water-inlet pipe 6 may be replaced conveniently.

Figure 7:
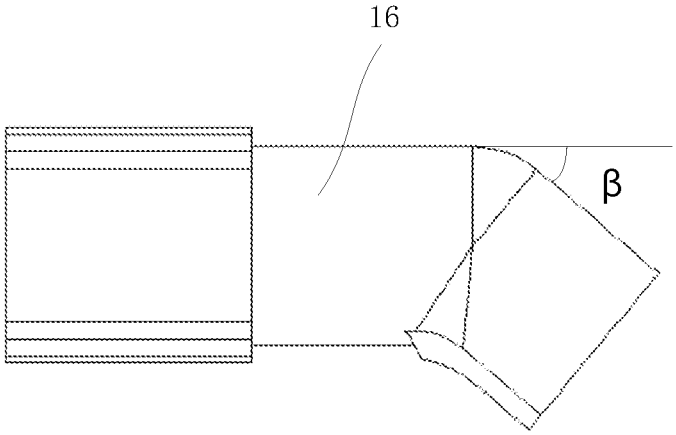
FIG. 7 is a structure diagram of a water-outlet pipe of an ice maker in a refrigerator according to some embodiments of the present disclosure.

In general, if an outlet of a water supply pipe points to a horizontal direction, and the water flowing out from the outlet flows along a parabolic track, so the location of a water drop is affected by flow velocity of the water and is prone to spatter. In some embodiments of the present disclosure, as shown in FIG. 3, the first end of the diversion pipe 11 is connected to the outlet pipe 16 of the ice maker, and the outlet pipe 16 is bent downward at an end away from the diversion pipe 11 to prevent the water entering the ice maker splash. The end of the water-outlet pipe 16 away from the diversion pipe 11 is an outlet for water and has a function of guiding the water flow into the ice maker. Since external water has a large range of water pressure fluctuations, the end of the outlet pipe 16 away from the diversion pipe 11 is bent downward to control a direction of the outlet water and reduce the flow velocity of the water, thereby avoiding water at the outlet end from being deflected or falling outside the area of the ice maker under a high water pressure, and preventing the splash of water. In some embodiments of the present disclosure, as shown in FIG. 7, the angle between the end of the outlet pipe 16 away from the diversion pipe 11 and a horizontal plane is β, and the value of β needs to take into account a length and an outer diameter of the outlet pipe 16, and an inner diameter of an installing portion in the refrigerator in which the diversion pipe 11 is installed. If the angle β is large, the entire diversion pipe 11 may be difficult to insert into the installation portion of the refrigerator. Therefore, β should be as large as possible without affecting the inserting of the diversion pipe 11 into the installation portion in the refrigerator. For example, the value of β is between 30 degrees and 45 degrees. In addition, in some embodiments of the present disclosure, the first end of the diversion pipe 11 and the outlet pipe 16 are in an interference fit so as to ensure the connection reliable and prevent water leakage.

Figure 8:
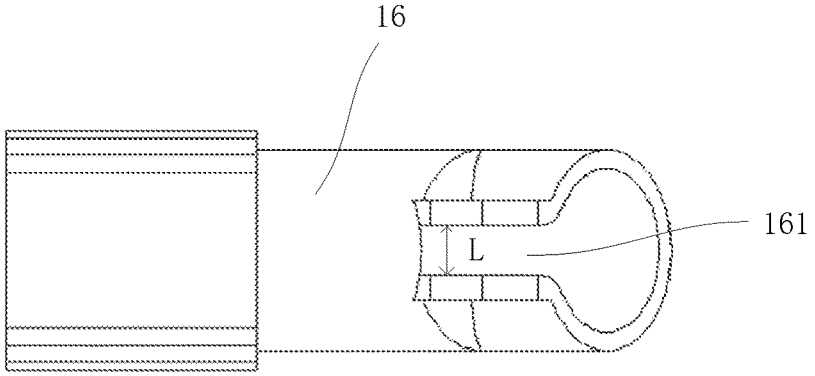
FIG. 8 is a structure diagram of a notch being provided in a water-outlet pipe of an ice maker in a refrigerator according to some embodiments of the present disclosure.

In a case that the water-outlet pipe 16 is bent downward at the end away from the diversion pipe 11, when water pressure of inlet water is small, water may remain at the bent portion. If the remaining water is frozen, the outlet of the outlet pipe 16 may be blocked. Therefore, in some embodiments of the present disclosure, as shown in FIG. 8, a lower wall of one end of the water-outlet pipe 16 away from the diversion pipe 11 is provided with a notch 161. In this way, the water at the bend of the outlet pipe 16 will flow out from the notch 161 and will not remain. The "lower wall" here indicates the wall of the side of the outlet pipe 16 that is close to an ice making container in the ice maker. The ice making container is used to receive the water flowing out of the outlet pipe 16.

In some embodiments, as shown in FIG. 8, a width L of the notch 161 is one-third of the inner diameter of the outlet pipe 16.

In some embodiments of the present disclosure, the water-feed assembly 1 is provided near the first end of the pre-embedded pipe 5 near the outside of the box 2, and an installation of the water-feed assembly 1 may be operated from the outside of the box 2, which is more convenient.

Figure 11:
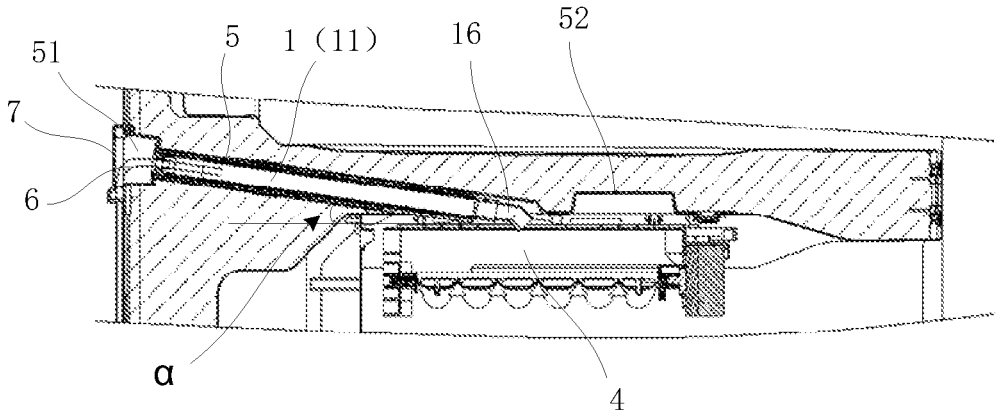
FIG. 11 is a partially enlarged structure diagram of a water-feed assembly provided in a refrigerator according to some embodiments of the present disclosure.

In some embodiments of the present disclosure, in order to facilitate flow of water and prevent residual water in the water-feed assembly 1, referring to FIG. 11, the water-feed assembly 1 is provided obliquely downward at an angle, that is, one end of the water-feed assembly 1 near the ice maker 4 is closer to the plane where the ice making container is placed in the ice maker 4 than the other end of the water-feed assembly 1 near the outside of the box 2.

In some embodiments of the present disclosure, in order to install the water-feed assembly 1 smoothly, the pre-embedded pipe 5 is also provided obliquely downward at an angle, that is, one end of the pre-embedded pipe 5 near the ice maker 4 is closer to the plane where the ice making container is placed in the ice maker than the other end of the pre-embedded pipe 5 near the outside of the box 2.

In some embodiments of the present disclosure, as shown in FIG. 9, the freezer compartment 3 is provided under the refrigerator, and the cooler compartment 8 is provided above the refrigerator; the ice maker 4 of the refrigerator is provided above the interior of the freezer compartment 3. Therefore, in order to facilitate water supply to the ice maker 4 from the water-feed assembly 1 installed in the pre-embedded pipe 5, the pre-embedded pipe 5 is usually disposed in a foamed layer between the cooler compartment 8 and the freezer compartment 3 of the refrigerator.

Referring to FIG. 11, α is the angle between the pre-embedded pipe 5 and the horizontal plane. The value of α needs to take into account a distance between the cooler compartment 8 and the freezer compartment 3 of the refrigerator and a relative position of the ice maker 4 in a front-rear direction within the freezer compartment 3. Therefore, the value of a should be as large as possible without affecting assembly and manufacturability. For example, in some embodiments of the present disclosure, a is greater than or equal to 5 degrees. In addition, in some embodiments of the present disclosure, in order to prevent cold air in the freezer compartment 3 from leaking from the pre-embedded pipe 5 to the outside of the box 2, in a case that the water-feed assembly 1 fits into the pre-embedded pipe 5, the heat insulation sheath 17 in the water-feed assembly 1 is in interference fit with the pre-embedded pipe 5.

Figure 12:
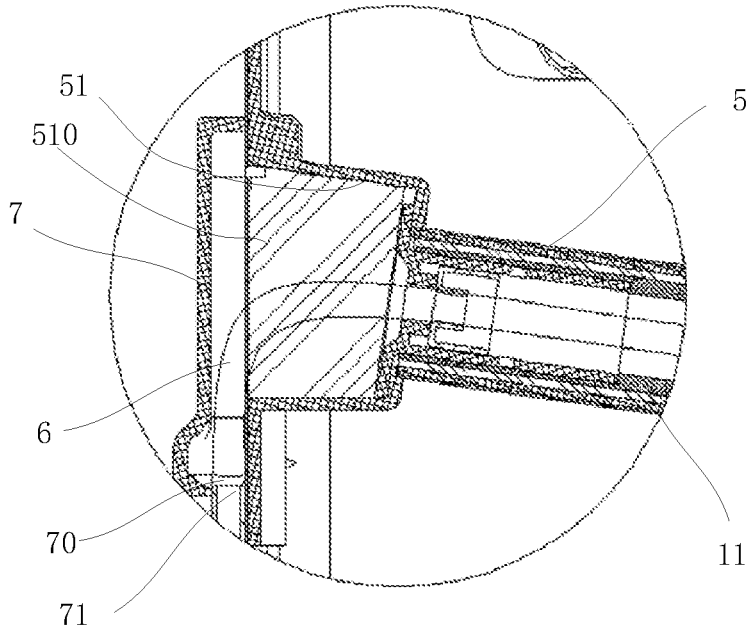
FIG. 12 is a structure diagram of a connection cavity being provided in a first end of a pre-embedded pipe of a refrigerator according to some embodiments of the present disclosure.

As shown in FIGS. 11 and 12, since the water-inlet pipe 6 is inserted into the pre-embedded pipe 5 inside the box 2 from the outside of the box 2, and is connected with the water-feed assembly 1, the extending direction of the portion of the water-inlet pipe 6 outside the box 2 may not coincide with the extending direction of the embedded pipe 5. In some embodiments of the present disclosure, for beauty, convenience and space saving, a portion of the water-inlet pipe 6 located outside the box 2 is usually provided in close contact with the exterior of the box 2.

The water-inlet pipe 6 must be bent at the opening of the second end of the pre-embedded pipe 5, and the bent portion of the water-inlet pipe 6 needs enough space to bend, to ensure the smooth flow of the pipe. Therefore, in some embodiments of the present disclosure, the second end of the pre-embedded pipe 5 is formed with a connection cavity 51 to provide a sufficient bending space for the water-inlet pipe 6. A bending space refers to a space for the water-inlet pipe 6 to bend. In some embodiments of the present disclosure, a cover 7 is also provided at the opening of the connection cavity 51. The cover 7 is provided with an opening 71, and the water-inlet pipe 6 passes through the opening 71 and the connection cavity 51. In addition, the connection cavity 51 may also facilitate the operation to the water-inlet pipe 6. The cover 7 covers the opening of the connection cavity 51 to ensure an aesthetic appearance of the structure.

In some embodiments of the present disclosure, in order to prevent the cold air in the refrigerator from leaking out from the connection cavity 51, the connection cavity 51 is filled with an insulation material 510. In some embodiments, the insulating material 510 is filled between the inner wall of the connection cavity 51 and the outer wall of the diversion pipe 11. The insulating material 510 is used to block the heat exchange between the cold air inside the refrigerator and the outside world. The heat insulating material 510 includes, but is not limited to, heat insulation wool, heat insulation foam and the like.

In a case that the connection cavity 51 is provided, the water pipe seat 15 is fixedly snap-fitted with the inner wall of the connection cavity 51 after the water-feed assembly 1 is inserted into the pre-embedded pipe 5. In other embodiments of the present disclosure, the connection cavity 51 is eliminated, that is, the first end of the pre-embedded channel 5 directly communicates with the outside of the box 2, and the water pipe seat 15 is directly fixed with the outer wall of the box 2 after the water-feed assembly 1 reaches into the pre-embedded channel 5.

In some embodiments of the present disclosure, in order to further prevent cold air in the refrigerator leakage, the outer wall of the water-inlet pipe 6 that mates with the opening 71 is covered with a heat insulation layer. The heat insulation layer is made of heat insulation material such as heat insulation wool or rubber.

Figure 13:
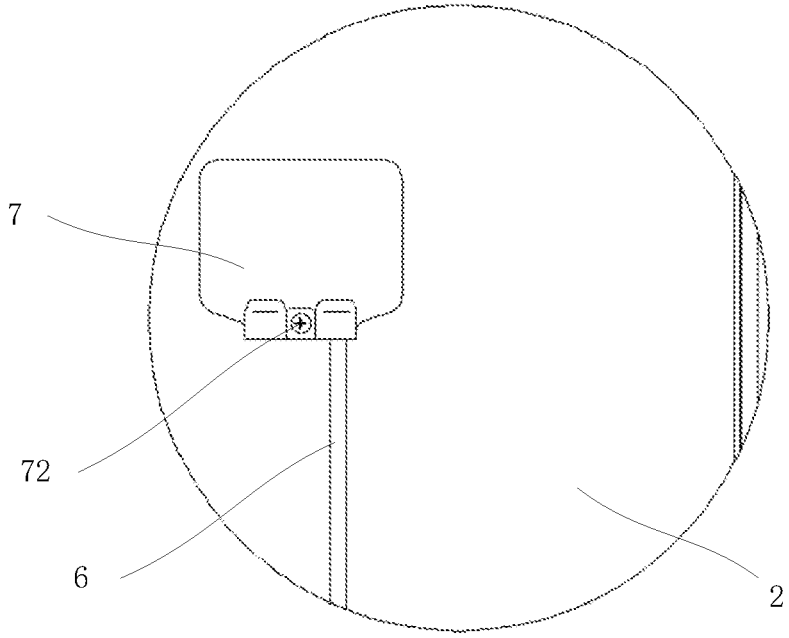
FIG. 13 is a structure diagram of an outside of a box of a refrigerator after being installed with a water-feed assembly according to some embodiments of the present disclosure.

A fixing of the cover 7 may be a snap-fastening, a screw-fixing, or the like. For example, as shown in FIG. 13, the cover 7 is fixed on the connection cavity 51 by screws 72. In addition, in some embodiments of the present disclosure, in order to clamp the water-inlet pipe 6 and prevent leakage of cold air, a resilient jacket 70 is provided at the position where the water-inlet pipe 6 joins with the opening 71. The resilient jacket 70 is disposed between the opening 71 and the water-inlet pipe 6. The resilient jacket 70 is in interference fit with the opening 71 and clamps the water-inlet pipe 6 to prevent leakage of cold air.

The connection terminal 121 connected to the heating wire wound on the heating layer 12 of the water-feed assembly 1 may connected with a wire in the refrigerator. In some embodiments of the present disclosure, referring to FIGS. 10 and 11, an assembly portion 52 is provided above the freezer compartment 3, and the connection terminal 121 may be conveniently connected to a corresponding line terminal of the assembly portion 52 to provide power for the heater wire. The corresponding line terminal of the assembly portion 52 is then connected to the wire in the refrigerator.

In the descriptions of the implementations, specific features, structures, materials or characteristics can be combined appropriately in any one or more embodiments or examples.

Additional embodiments including any one of the embodiments described above may be provided by the disclosure, and one or more of components, functionalities or structures in the additional embodiments is replaced or supplemented by one or more of the components, functionalities or structures of embodiments described above.

The foregoing descriptions merely show specific implementations of the present disclosure, and the protection scope of the present disclosure is not limited thereto. Any person of skill in the art can readily conceive of variations or replacements within the technical scope disclosed by the embodiments of the present disclosure, and these variations or replacements shall fall into the protection scope of the present disclosure. Accordingly, the protection scope of the present disclosure shall be subject to the protection scope of the claims.

What is claimed is:

1. A water-feed assembly of an ice maker in a refrigerator, the water-feed assembly comprising:

a diversion pipe, wherein an outer wall of the diversion pipe is covered with a heating layer, and wherein a first end of the diversion pipe is used for communicating with a water-outlet pipe in the ice maker of the refrigerator;

a locating sleeve connected with a second end of the diversion pipe;

a resilient sealing sleeve having a body portion and a radial flange, wherein the body portion is located on an inner wall of a port of the locating sleeve, and the port of the locating sleeve is away from the diversion pipe, and wherein the radial flange extends from an outer end of the body portion along an end face of the locating sleeve; and a water pipe seat, wherein an end of the water pipe seat is connect to the locating sleeve at a location that is spaced from the diversion pipe, wherein the water pipe seat abuts a first side of the radial flange, and wherein a second side of the radial flange abuts the end face of the locating sleeve.

2. The water-feed assembly according to claim 1, wherein the locating sleeve is a resilient member, and wherein an end of the locating sleeve is inserted into the second end of the diversion pipe with an interference fit.

3. The water-feed assembly according to claim 1, wherein an end of the locating sleeve is inserted into the diversion pipe and is snap-fitted by a first snap fit structure, and wherein the first snap fit structure is configured to prevent a relative movement between the locating sleeve and the diversion pipe along an axial direction.

4. The water-feed assembly according to claim 3, wherein the first snap fit structure comprises a limiting column provided on an outer wall of the position sleeve and a groove provided on an inner wall of the diversion pipe, wherein the groove comprises an axial segment extending axially and a circumferential segment extending circumferentially, wherein an end of the axial segment communicates with the circumferential segment, and wherein an opposite end extends to an end face of the second end of the diversion pipe, and wherein the limiting column is snap-fitted with the circumferential segment to limit an axial movement of the locating sleeve relative to the diversion pipe.

5. The water-feed assembly according to claim 1, wherein the water pipe seat comprises:

a first port for installing a water-inlet pipe, the water-inlet pipe being used to communicate with an external water source, and a second port for connecting with the locating sleeve, the second port communicating with the first port, wherein the second port of the water pipe seat is sleeved outside the locating sleeve, and wherein the inner wall of the locating sleeve abuts an outer wall of the body portion of the resilient sealing sleeve, and an inner wall of the body portion of the resilient sealing sleeve abuts the outer wall of the water-inlet pipe.

6. The water-feed assembly according to claim 5, wherein the second port of the water pipe seat is sleeved outside the locating sleeve and a part of the diversion pipe, and wherein the water pipe seat and the locating sleeve are snap-fitted by a second snap fit structure configured to prevent a relative movement between the water pipe seat and the locating sleeve along an axial direction.

7. The water-feed assembly according to claim 6, wherein the second port of the water pipe seat includes a stop projection which extends along an axial direction of the second port and abuts against the radial flange.

8. The water-feed assembly according to claim 6, wherein the second snap fit structure comprises a resilient buckle located on an outer wall of the locating sleeve and an engaging hole located on an inner wall of the second port of the water pipe seat, and wherein the resilient buckle is snap-fitted with the engaging hole to limit a movement of the water pipe seat relative to the locating sleeve along an axial direction.

9. The water-feed assembly according to claim 1, wherein the resilient seal sleeve further comprises: an axial flange extending along an axial direction of the resilient sealing sleeve from a distal end of the radial flange, and the axial flange is covered on an outer wall of the locating sleeve.

10. The water-feed assembly according to claim 1, wherein an outer wall of the water pipe seat is covered with the heating layer.

11. The water-feed assembly according to claim 1, wherein the heating layer is covered with a heat insulating sheath.

12. A refrigerator, the refrigerator comprising a box provided with a freezer compartment and an ice maker being provided in the freezer compartment, wherein:

a pre-embedded pipe is located in a foamed layer of an inner liner of the freezer compartment, a first end of the pre-embedded pipe communicates with the outside of the box, and a second end of the pre-embedded pipe communicates with the freezer compartment and is located opposite to an ice making area in the ice maker, a water-feed assembly is detachably located in the pre-embedded pipe, and the water-feed assembly comprises:

a diversion pipe, wherein an outer wall of the diversion pipe is covered with a heating layer, and wherein a first end of the diversion pipe is used for communicating with a water-outlet pipe in the ice maker of the refrigerator, a locating sleeve, connected with a second end of the diversion pipe, a resilient sealing sleeve having a body portion and a radial flange, wherein the body portion is located on an inner wall of a port of the locating sleeve, and the port of the locating sleeve is away from the diversion pipe, and wherein the radial flange extends from an outer end of the body portion along an end face of the locating sleeve, a water pipe seat, wherein an end of the water pipe seat is connect to the locating sleeve at a location that is spaced from the diversion pipe, wherein the water pipe seat abuts a first side of the radial flange, and wherein a second side of the radial flange abuts the end face of the locating sleeve, wherein the resilient sealing sleeve of the water-feed assembly is located near the first end of the pre-embedded pipe, and a water-inlet pipe is provided in the pre-embedded pipe.

13. The refrigerator according to claim 12, wherein the first end of the pre-embedded pipe is formed with a connection cavity, wherein an outlet of the connection cavity has a cover with an opening, and wherein the water-inlet pipe passes through the opening and the connection cavity.

14. The refrigerator according to claim 13, wherein a heat insulating material fills a space between an inner wall of the connection cavity and an outer wall of the water-inlet pipe.

15. The refrigerator according to claim 13, wherein a resilient jacket is located at a position where the water-inlet pipe joins with the opening, wherein the resilient jacket is located inside the opening with an interference fit with the opening, and wherein the resilient jacket is configured to clamp the water-inlet pipe.

16. The refrigerator according to claim 12, wherein the refrigerator further comprises the water-outlet pipe located in the ice maker of the refrigerator, wherein the water-outlet pipe communicates with the water-feed assembly, and wherein the water-outlet pipe is bent downward at an end of the water-outlet pipe and the end of the water-outlet pipe is away from the diversion pipe.

17. The refrigerator according to claim 16, wherein a lower wall of an end of the water-outlet pipe includes a notch and the end of the water-outlet pipe is away from the diversion pipe.

18. The refrigerator according to claim 12, wherein an end of the water-feed assembly proximate the ice maker is closer to a plane where the ice making container is placed in the ice maker than an opposite end of the water-feed assembly proximate the outside of the box.

19. The refrigerator according to claim 12, wherein a heat-insulation sheath of the water-feed assembly is in interference fit with the pre-embedded pipe.

20. The refrigerator according to claim 12, wherein an assembly portion is located above the freezer compartment, wherein a connection terminal for supplying power to the heating layer of the water-feed assembly is connected to a corresponding line terminal of the assembly portion, and wherein the corresponding line terminal of the assembly portion is connected to a wire in the refrigerator.

* * * * *